US005917514A

United States Patent [19]

Higuma et al.

[11] Patent Number: 5,917,514

[45] Date of Patent: Jun. 29, 1999

[54] SEALING MEMBER FOR INK CARTRIDGE

[75] Inventors: Masahiko Higuma, Togane; Takashi Watanabe, Yokohama; Hiroyuki Ishinaga, Tokyo; Takahisa Kawamura, Yokohama; Seiichiro Karita, Yokohama; Akihiro Yamanaka, Yokohama; Norio Ohkuma, Yokohama; Akira Goto, Yokohama; Teruo Arashima, Kawasaki; Motoaki Sato, Tokyo; Megumi Saito, Kawasaki, all of Japan

[73] Assignee: Canon Kabushiki Kaisha, Tokyo, Japan

[21] Appl. No.: 08/919,268

[22] Filed: Aug. 28, 1997

Related U.S. Application Data

[63] Continuation of application No. 08/785,839, Jan. 21, 1997, which is a continuation of application No. 08/304,824, Sep. 13, 1994, which is a continuation of application No. 07/846, 170, Mar. 5, 1992.

[30] Foreign Application Priority Data

| | | | |
|---|---|---|---|
| Mar. 8, 1991 | [JP] | Japan | 3-043653 |
| Mar. 8, 1991 | [JP] | Japan | 3-043666 |
| Jul. 15, 1991 | [JP] | Japan | 3-173959 |
| Mar. 2, 1992 | [JP] | Japan | 4-044771 |

[51] Int. Cl.[6] ..... B41J 2/165

[52] U.S. Cl. ..... 347/29; 206/813; 428/343; 347/22; 347/29

[58] Field of Search ..... 347/22, 29, 44, 347/86, 87, 85; 292/307 R; 206/813; 428/343, 355; 525/123

[56] References Cited

U.S. PATENT DOCUMENTS

| | | | |
|---|---|---|---|
| 4,312,916 | 1/1982 | Kakumaru et al. | 428/355 X |
| 4,524,104 | 6/1985 | Hagio et al. | 428/355 X |
| 4,987,186 | 1/1991 | Akiyama et al. | 525/123 X |
| 5,051,759 | 9/1991 | Karita et al. | 346/140 R |

FOREIGN PATENT DOCUMENTS

| | | | |
|---|---|---|---|
| 0001134 | 3/1979 | European Pat. Off. . | |
| 0418828 | 3/1991 | European Pat. Off. . | |
| 3825046 | 1/1990 | Germany . | |
| 59-198161 | 11/1984 | Japan . | |
| 60-204348 | 10/1985 | Japan . | |
| 61-125851 | 6/1986 | Japan . | |
| 0000185 | 1/1989 | Japan . | |
| 0256582 | 10/1989 | Japan . | |
| 0263182 | 10/1989 | Japan | 428/355 |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

An adhesive sheet-type sealing member is suitably used for protecting ink-ejecting nozzles or a communication hole of an ink-jet recording head during transportation or storage. The sealing member exhibits a yield point at a load of not more than 1 kgf/cm for a specimen of 10 mm wide at a stress rate of 200 mm/min ±10% according to JIS-K-7113 and/or exhibits a folding load of not more than 0.10 g/cm for a specimen of 10 mm wide with a free length of 10 mm from the end of a specimen holder measured on the center of an electronic balance placed at a position 5 mm apart from the end of the specimen holder.

12 Claims, 12 Drawing Sheets

FIG.12A
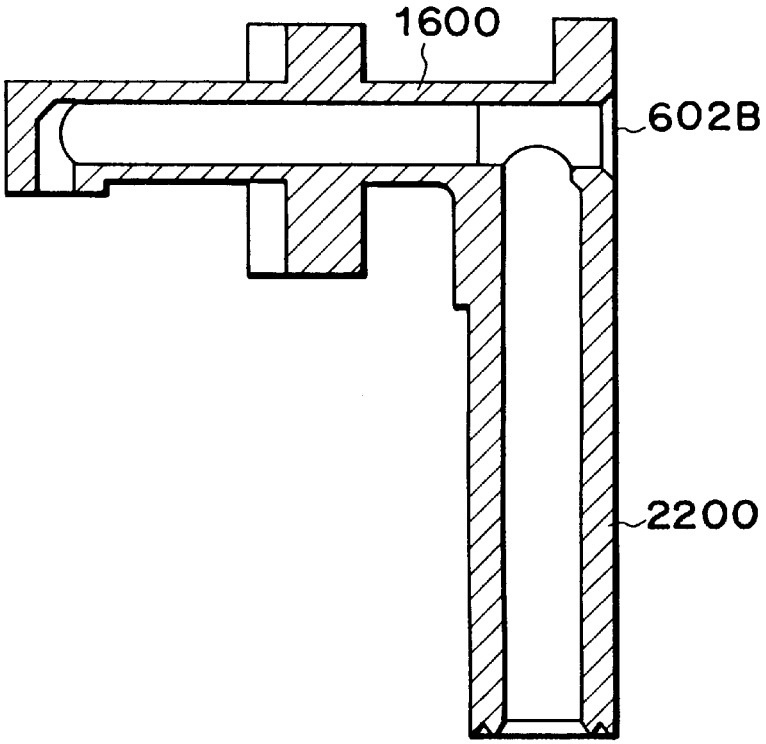
FIG.12C
FIG.12B
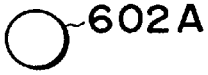
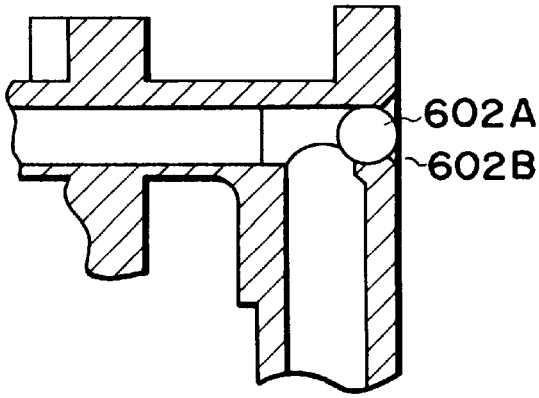

SEALING MEMBER FOR INK CARTRIDGE

This application is a continuation of application Ser. No. 08/785,839 filed Jan. 21, 1997, which is a continuation of application Ser. No. 08/304,824 filed Sep. 13, 1994, which is a continuation of application Ser. No. 07/846,170 filed Mar. 5, 1992.

BACKGROUND OF THE INVENTION

1. Field of the Invention

The present invention relates to a thin film member useful for sealing an ink outlet (an ejection outlet or the like) or an air communication hole, or for fixing tentatively an article of an ink-recording head. The present invention also relates to a recording head employing the thin film member. The thin film of the present invention is suitably used as a sealing tape.

2. Related Background Art

Conventionally, in ink-jet apparatuses, clogging of ink-nozzles during transportation, or trouble in ink ejection, is prevented by covering the ink ejection outlet face with a capping device having an absorbent as described in Japanese Patent Application Laid-Open No. 59-198161.

Recently, cartridge type ink-jet recording heads having an integral ink tank have been developed, and consequently, protecting members for protecting the ink ejection outlet face without employing a capping device are proposed. Typically, for example, Japanese Patent Application Laid-Open No. 60-204348 discloses a cap-shaped protecting member having an ink absorbent provided at the ejection outlet; and Japanese Patent Application Laid-Open No. 61-125851 discloses a sealing tape composed basically of a vinylidene chloride resin for protecting the ejection outlet.

The conventional capping devices, however, are liable to cause overflow of ink during transportation of an ink-jet recording apparatus owing to rough movement during the transportation or other causes. The overflow leads to soiling of the interior of the recording apparatus.

This phenomenon was studied, and has been newly found to be dependent largely on the overall properties of the sealing member itself including its adhering portion that bonds to the opening or the joint portion, rather than on the bonding strength of the pressure-sensitive adhesive. Further comprehensive study on the properties has made it clear that elongation or bending properties of the sealing member in a thin film form (e.g., a tape) are important for resistance to environmental variation and for durability. Accordingly, the present invention is directed to exclude the use of a cap-shaped protecting member to fix the sealing member by giving it suitable conditions to seal an ink container portion.

A conventional protecting sealing tape, for example, which is constituted at least of a support and a pressure-sensitive adhesive layer laminated thereon is not satisfactory in sealing of an irregular face, resulting in gradual peeling during a long term of storing to cause leakage of ink. The sealing member is required to be capable of preventing ink leakage for a long term, even in the case where the sealed face has a stepped structure, an irregular surface structure, or a discontinuous structure.

SUMMARY OF THE INVENTION

An object of the present invention is to provide a sealing member which is capable of preventing, by itself, ink leakage from an ink container during transportation, and which enables a long term of storage of an ink-jet recording head.

An object of the present invention is to provide a protective sealing tape for an ink-jet recording head which allows immediate start of ink recording without adverse effect of an eluted matter from an adhering portion of the sealing member or a remaining adhesive matter after removal of the sealing member.

The present invention provides a sealing member for sealing, with a pressure-sensitive adhesive portion thereof, a communicating hole or a joint portion between the interior and the exterior of a recording/container portion holding therein an ink, the sealing member exhibiting a yield point at a load of not more than 1 kgf/cm for a specimen of 10 mm wide at a stress rate of 200 mm/min±10% according to JIS-K7113.

The present invention also provides a sealing member for sealing, with a pressure-sensitive adhesive portion thereof, a communicating hole or a joint portion between the interior and the exterior of a recording/container portion holding therein an ink, the sealing member exhibiting a folding load of not more than 0.10 g/cm for a specimen of 10 mm wide with a free length of 10 mm from the end of a specimen holder measured on the center of an electronic balance placed at a position 5 mm apart from the end of the specimen holder.

The present invention further provides a recording head having an ink container, an energy-generating element for generating energy for ejecting an ink held in the ink container, an ink-ejecting portion corresponding to the energy-generating element, and a sealing member, the sealing member being as defined above.

The sealing member is effective when it is applied onto a portion where an ink exists in proximity, the portion such as an ink ejecting portion corresponding to an energy-generating element of an ink-jet recording head. In such a case, for the purpose of decreasing satisfactorily a remaining pressure-sensitive adhesive component, the pressure-sensitive adhesive comprises an acrylate ester copolymer crosslinked by an isocyanate, the acrylate ester copolymer being composed of at least 80% by weight in total of an alkyl and/or alkoxyalkyl acrylate ester containing an hydroxy group, and an acrylate ester having a side chain of an alkyl or alkoxyalkyl group of 4 to 9 carbons.

In the case where the portion to be sealed by the sealing member is stepped, the aforementioned folding load of not more than 0.05 g/cm and not less than 0.01 g/cm of the sealing member enables effective sealing.

The sealing member of the present invention is suitably used for ink-jet recording heads to protect the ejection portion thereof and to prevent ink leakage from the ejection outlet during a long term of storage.

The sealing member of the present invention is readily peelable at the start of ink-jet recording even after a long term of storage of an ink-jet recording head, not causing soiling around the ink ejection outlet, thus enabling satisfactory ink-jet recording.

Further, the sealing member of the present invention can achieve by itself the above-mentioned objects without employing an additional structure, namely an additional protecting member (for example, a pressing member) to prevent the peeling.

BRIEF DESCRIPTION OF THE DRAWINGS

FIG. 12A to FIG. 12C illustrates a constitution of an ink-feeding portion which connects an ink tank of a cartridge of the present invention with a recording head. FIG. 12A illustrates an ink-feeding portion. FIG. 12B illustrates a sealing ball. FIG. 12C illustrates an assemblage thereof.

DESCRIPTION OF THE PREFERRED EMBODIMENT

Figure 1A:
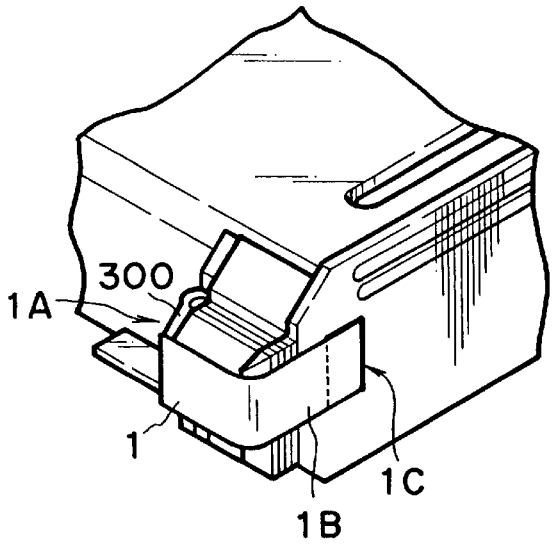
FIG. 1A to FIG. 1C are rough perspective views of examples of the use of a seal tape of the present invention.

The sealing member of the present invention yields at a load of not more than 1 kgf/cm for a specimen of 10 mm wide at a stress rate of 200 mm/min±10% according to JIS-K7113. No proper criterion has ever been given for evaluating sealing properties for faces of such as an ejection outlet of an ink-jet recording head. Therefore, the investigation began with a study to provide a criterion for evaluation of the sealing properties on such a surface, in particular a surface for a joint portion including an inclined portion and a corner portion. The above-mentioned JIS-K-7113 itself is not a standard to be applied to a sealing member like the one of the present invention. However, the inventors of the present invention, after comprehensive study, succeeded to evaluate the properties of a thin film having a pressure-sensitive adhesive as a sealing member by taking the load at yield point, as the evaluation criterion, for a specimen 10 mm wide at stress rate of 200 mm/min±10%. The load of 1 kgf/cm at the yield point is the critical criterion. In the case where the measured load was more than 1 kgf/cm, the sealing member could not seal a jointed region stably for a long term.

When the width of the specimen is not 10 mm, the measured load may be converted to the value for the width of 10 mm to denote the load at yield in terms of the kgf/cm unit as defined in the present invention.

In addition to the above-mentioned load at the yield point, another independent evaluation criterion was found for proper evaluation of the properties. The evaluation criterion is that the sealing member has a folding load of not more than 0.10 g/cm, for a specimen 10 mm wide with a free length of 10 mm from a supported end, at a position 5 mm apart from the supported end and at the center of an electronic balance pan. This evaluation is found to be effective for specimens having a free length of at least 10 mm. In this evaluation criterion, the value of 0.10 g/cm is the critical criterion. At the folding load exceeding 0.07 g/cm, the peeling is remarkable, while at the folding load of not more than 0.10 g/cm, the sealing member achieves stable sealing effect for the ink container for a long term.

The pressure-sensitive adhesive includes various known materials. Preferable are acrylic materials, particularly preferably acrylate ester copolymers crosslinked by an isocyanate, the acrylate ester copolymer being composed of at least 80% by weight in total of a hydroxyalkyl acrylate and/or an alkoxyalkyl acrylate, and an acrylate ester having a side chain of an alkyl or alkoxyalkyl group of 4 to 9 carbons.

The acrylic monomer for the pressure-sensitive acrylic material includes alkyl ester monomers such as methyl acrylate, ethyl acrylate, propyl acrylate, isopropyl acrylate, butyl acrylate, isobutyl acrylate, 2-methylbutyl acrylate, 2-ethylbutyl acrylate, 3-methylbutyl acrylate, 1,3-dimethylbutyl acrylate, pentyl acrylate, 3-pentyl acrylate, hexyl acrylate, 2-ethylhexyl acrylate, heptyl acrylate, 2-heptyl acrylate, octyl acrylate, 2-octyl acrylate, nonyl acrylate, and the like. A variety of alkoxyalkyl ester monomers can also be used. Such a monomer is used in combination with the hydroxy-group-containing monomer in a total amount ranging from 50 to 100% by weight, preferably from 50 to 80% by weight.

The polyvalent isocyanate compound includes tolylene diisocyanate, hexamethylene diisocyanate, diphenylmethane diisocyanate, isophorone diisocyanate, xylylene diisocyanate, bis(isocyanatomethyl)cyclohexane, dicyclohexylmethane diisocyanate, lysine diisocyanate, trimethylhexamethylene diisocyanate, adducts of tolylene diisocyanate and hexamethylene diisocyanate, urethane-modified compounds, allophanate-modified compounds, biuret-modified compounds, isocyanurate-modified compounds, urethane prepolymers (oligomeric compounds having an isocyanate group at each end), and the like.

The cohesion property of the pressure-sensitive adhesives can be adjusted by various methods.

A first method of adjusting the cohesion property of the pressure-sensitive adhesive is copolymerization with a hydroxy-group-containing monomer and crosslinking by use of a polyvalent isocyanate compound. The hydroxy-group-containing monomer includes 2-hydroxyethyl acrylate, 2-hydroxypropyl acrylate, hydroxybutyl acrylate, 2-hydroxyethyl methacrylate, 2-hydroxypropyl methacrylate, hydroxybutyl methacrylate, acrylate esters of polyhydric alcohol, methacrylate ester of polyhydric alcohol, an acrylate ester of ethylcarbitol, an acrylylate ester of methyltriglycol, 2-hydroxyethyl acryloylphosphate, propoxyethyl acrylate, and so forth. The hydroxy-group-containing monomer is used preferably in an amount ranging from 5 to 25% by weight, and a part or the whole thereof is crosslinked by polyvalent isocyanate.

A second method of adjusting the cohesion property of the pressure-sensitive adhesive is appropriate use of copolymerization component such as a methacrylate monomer, vinyl acetate, styrene, acrylonitrile, acrylamide, and methacrylamide. Such a component is preferably used in an amount ranging from 5 to 15% by weight. From among the components, acrylonitrile, acrylamide, and methacrylamide are particularly suitable for the ink-jet recording head of the present invention.

A third method of adjusting the cohesion property of the pressure-sensitive adhesive is crosslinking with a crosslinking monomer such as N-methylolacrylamide, N-methylolmethacrylamide, diacetonacrylamide, and butoxymethylacrylamide. The crosslinking monomer is preferably used in an amount ranging from 5 to 15% by weight.

For a more suitable pressure-sensitive adhesive, the first method of the adjustment is preferably combined with the second or the third method.

The pressure-sensitive adhesive employed in the present invention has higher chemical resistance against an ink-jet ink, giving less elution of organic compounds, containing less amount of polyvalent metal, and having excellent properties for protecting the nozzle surface of the ink-jet recording head.

The pressure-sensitive adhesive may be produced by polymerizing the aforementioned materials by a known polymerization process into a high polymer having a weight-average molecular weight of from 250,000 to 1,000,000. In the polymerization, the content of low polymers and remaining monomers are required to be as low as possible. Thus, the polymerization process and the polymerization conditions have to be strictly controlled therefor. The low polymer and the remaining monomer is removed preferably by reprecipitation. The polymer thus prepared is dissolved in a good solvent, and a diisocyanate is added thereto to provide a paint. The paint is applied onto a supporting film to form a pressure-sensitive adhesive layer of a dry thickness in the range of from 5 $\mu$m to 100 $\mu$m by a known coating method such as blade coating, air-knife coating, roll coating, brush coating, curtain coating, Chamblex coating, bar coating, gravure coating, and the like method, and the applied paint is dried in a conventional manner. After the drying, the film may be subjected to an aging treatment at an appropriate temperature, if desired, for the purpose of stabilizing the properties of the pressure-sensitive adhesive.

The support for the pressure-sensitive adhesive of the present invention may be of any material such as paper and plastic films, provided that the seal tape formed by combination of the support and the pressure-sensitive adhesive satisfies the aforementioned criterion of the present invention. Synthetic papers and films made from a plastic is suitable in view of the durability and the weatherability. The film material includes polyethylene terephthalate, polyethylene, polypropylene, polyvinyl chloride, polyvinylidene chloride, vinylidene chloride-vinyl chloride copolymers, polyvinyl fluoride, polyvinylidene fluoride, tetrafluoroethylene-ethylene copolymers, tetrafluoroethylene-hexafluoropropylene-perfluoroalkyl vinyl ether copolymers, and the like. In consideration of the fact that the pressure-sensitive adhesive tape is peeled and discarded before the use of the recording head, polyethylene terephthalate, polyethylene, and polypropylene are preferred which generate no noxious gas on burning. The thickness of the support is preferably in the range of from 5 $\mu$m to 100 $\mu$m, more preferably from 10$\mu$ to 50 $\mu$m for use for a protecting seal tape, but is not limited thereto. The support may be colored by printing or immersion. Further, for the purpose of improving the adhesion with the pressure-sensitive adhesive, the support is preferably pretreated physically by employing a high-frequency alternate electric field, ion radiation, electron radiation, corona discharge, and the like, or pretreated chemically by applying a coupling agent, or the like before application of the pressure-sensitive adhesive.

For convenience of handling, the seal tape of the present invention may be laminated at the adhesive side onto a releasable base material, although it does not relate directly to the present invention.

The protecting seal tape of the present invention is applicable onto an ink-repelling surface of the ejection outlet of an ink-jet recording head, giving satisfactory sealing properties without deterioration of the tape and the ejection outlet surface. Incidentally, the aforementioned ink-repelling surface means a surface having been treated with a treating agent such as a silicone oil, a fluorine-containing low molecular or high molecular compound, specifically including KP-801 (trade name, made by Shin-Etsu Silicone K.K.), Defenser (trade name, made by Dainippon Ink and Chemicals, Inc.), CTX-105 and -805 (trade name, made by Asahi Glass Co., Ltd.), Teflon AF (trade name, made by DuPont Co.), and so forth.

The sealing member may be adhered in any method. However, the sealing member is preferably pressed at a pressure of not more than several kg/cm$^2$ not to break the surface of the ejection outlet of the ink-jet recording head, and the pressing is conducted for a time of from several seconds to 10 minutes. Heating at the pressure adhesion is highly desirable.

The ink-jet recording apparatus in which the present invention is utilized is described below by reference to FIG. 2 to FIG. 7.

Figure 2:
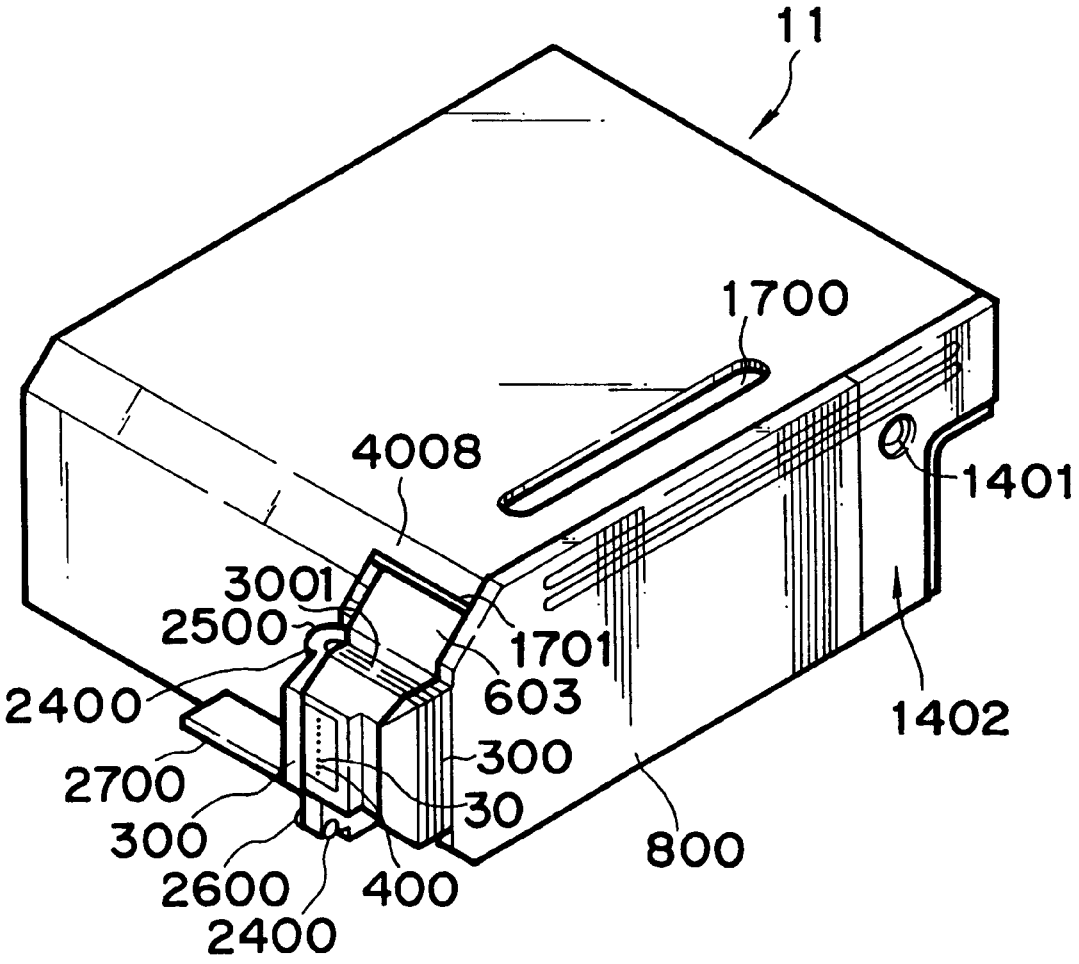
FIG. 2 is a perspective view of an ink-jet cartridge of the present invention.
Figure 3:
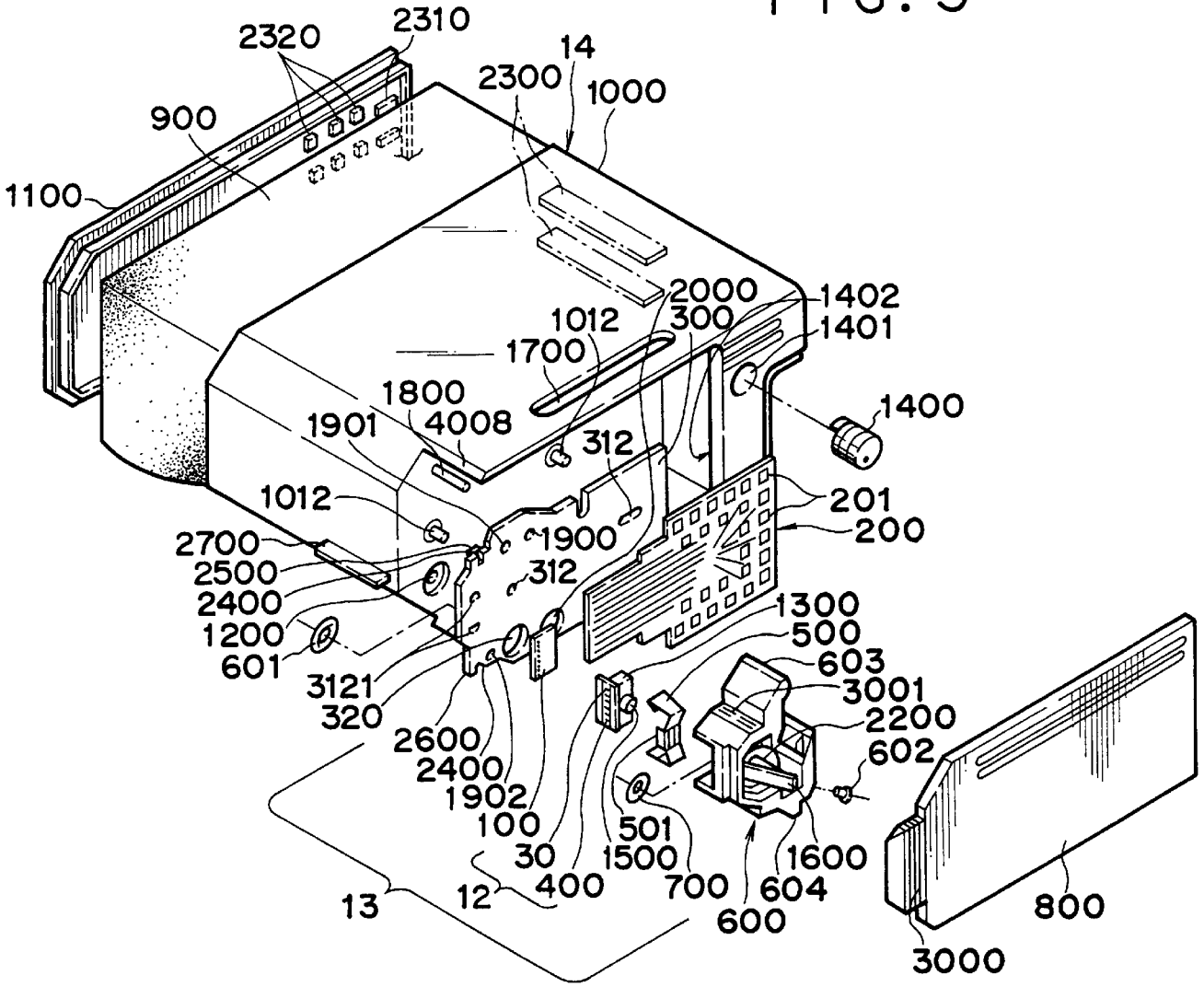
FIG. 3 is an perspective exploded view of an ink cartridge of the present invention.

FIG. 2 is a perspective view of an ink-jet cartridge 11 employed in an ink-jet recording apparatus of the present invention. FIG. 3 is an exploded view showing the construction of the ink-jet cartridge 11. The following description is mainly based on FIG. 3, and other referred drawings are denoted by FIG. number in parentheses.

The ink-jet cartridge 11 is constructed integrally from an ink-jet unit 13 including an ink-jet head 12 having a multiplicity of ejection outlets 30 formed in one body including a recording head, electric wiring thereto, tubes, and an ink tank 14 for holding ink. The ink-jet cartridge 11 of this example. has a larger ink-holding capacity than conventional ones, and has a tip portion of the ink unit 13 slightly projecting from the front face of the ink tank 14. This ink-jet cartridge 11 is fixed and supported by a registration means and electric contact points described later, is detachable from the carriage 16 (see FIG. 6) mounted on an ink-jet recording apparatus 15, and is disposable.

Figure 4:
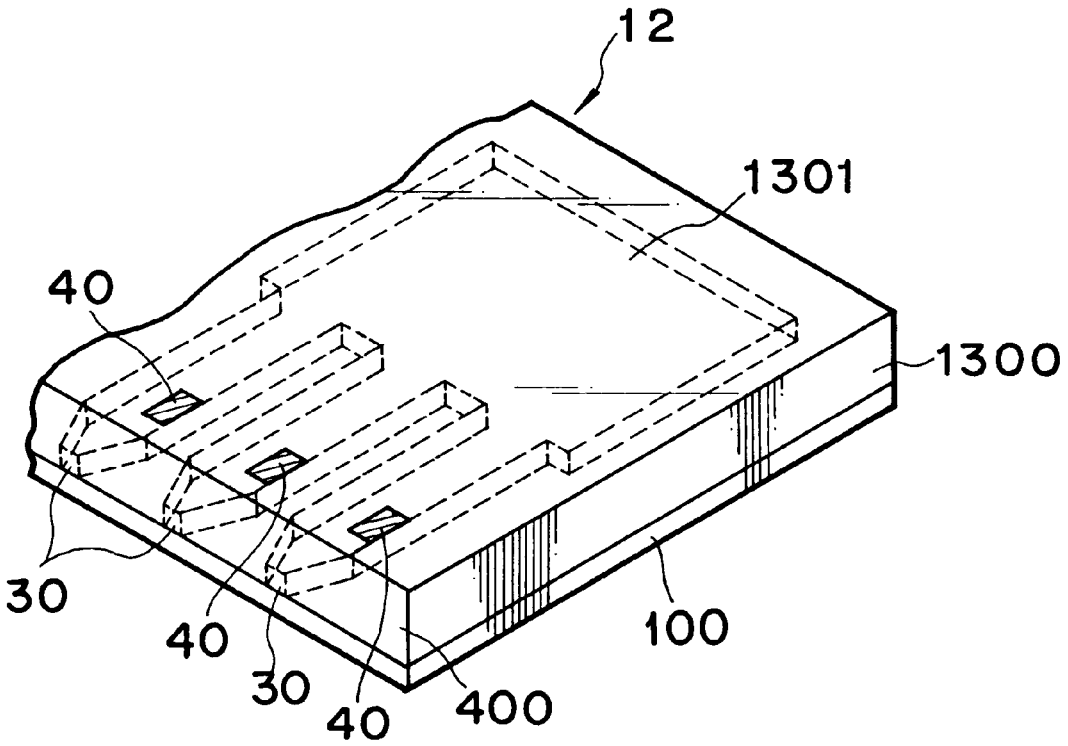
FIG. 4 is a rough drawing illustrating a head portion of an ink cartridge of the present invention.

Firstly, the construction of the ink-jet head 12 is explained. As shown in FIG. 4, the ink-jet head 12 has a plurality of ejection outlets 30 placed in line, and an electrothermal transducer 40 is provided in each liquid path for thermal energy generation by voltage application. Application of driving signals thereto causes generation of thermal energy in the electrothermal transducers 40, giving rise to film boiling to form bubbles in the ink liquid path. The growth of the bubbles serves to eject the ink droplets from the ejection outlets 30. The respective electro-thermal transducers 40 are provided on a heater board 100 composed of a silicon base plate, and are formed by a film-forming technique integrally with aluminum wiring (not shown in the drawing) for supplying electric power to the respective electro-thermal transducer. The grooved cover plate 1300 having separator for separating the plurality of ink paths and the common liquid chamber 1301 for holding ink temporarily, etc. and the orifice plate 400 having an ink inlet 1500 for introducing ink from the ink tank 14 to the common liquid chamber 1301 and a plurality of ejection outlets 30 corresponding to respective ink flow paths are formed integrally. The material therefor is preferably polysulfone, but other molding resins such as polyethersulfone, polyphenylene oxide, and the like are also applicable.

Secondly, the construction of the ink-jet unit 13 is explained.

The one end of the wiring base board 200 is connected to the wiring portion of the heater board 100 of the ink-jet head 12, and the other end of the wiring base board 200 is provided with a plurality of pads 201 corresponding to the respective electro-thermal transducer 40 (FIG. 4) for receiving electric signals from the main apparatus. Thereby the electric signals from the main apparatus is supplied to the respective electrothermal transducers 40.

A metallic support 300 which supports the wiring base board 200 at the back side serves as the bottom plate of the ink-jet unit 13. The presser bar spring 500, which has an M-shape, presses the common liquid chamber 1301 (FIG. 4) with the center portion of the M-shape. The apron portion 501 presses concentratedly a portion of the liquid paths, preferably the region around the ejection outlets 30, with a line pressure. The heater board 100 and the cover plate 1300 are engaged between the presser bar spring 500 and the support 300 with the foot portion of the presser bar spring engaged with the back side of the support 300 through the holes 3121, and press-fixed with each other by the concentrated force of the presser bar spring 500 and the apron portion 501 thereof. The support 300 has holes 312, 1900, and 2000 corresponding to the two registering projections 1012 of the ink tank 14, and registering and heat-fusion-holding projections, 1800 and 1801, and further has registering projections 2500 and 2600 at the back side corresponding to the carriage 16. The support 300 further has a hole 320 through which an ink-supplying tube 2200 (described later) from the ink tank 14 passes. Onto the support 300, a wiring base plate 200 is bonded by use of an adhesive.

Figure 6:
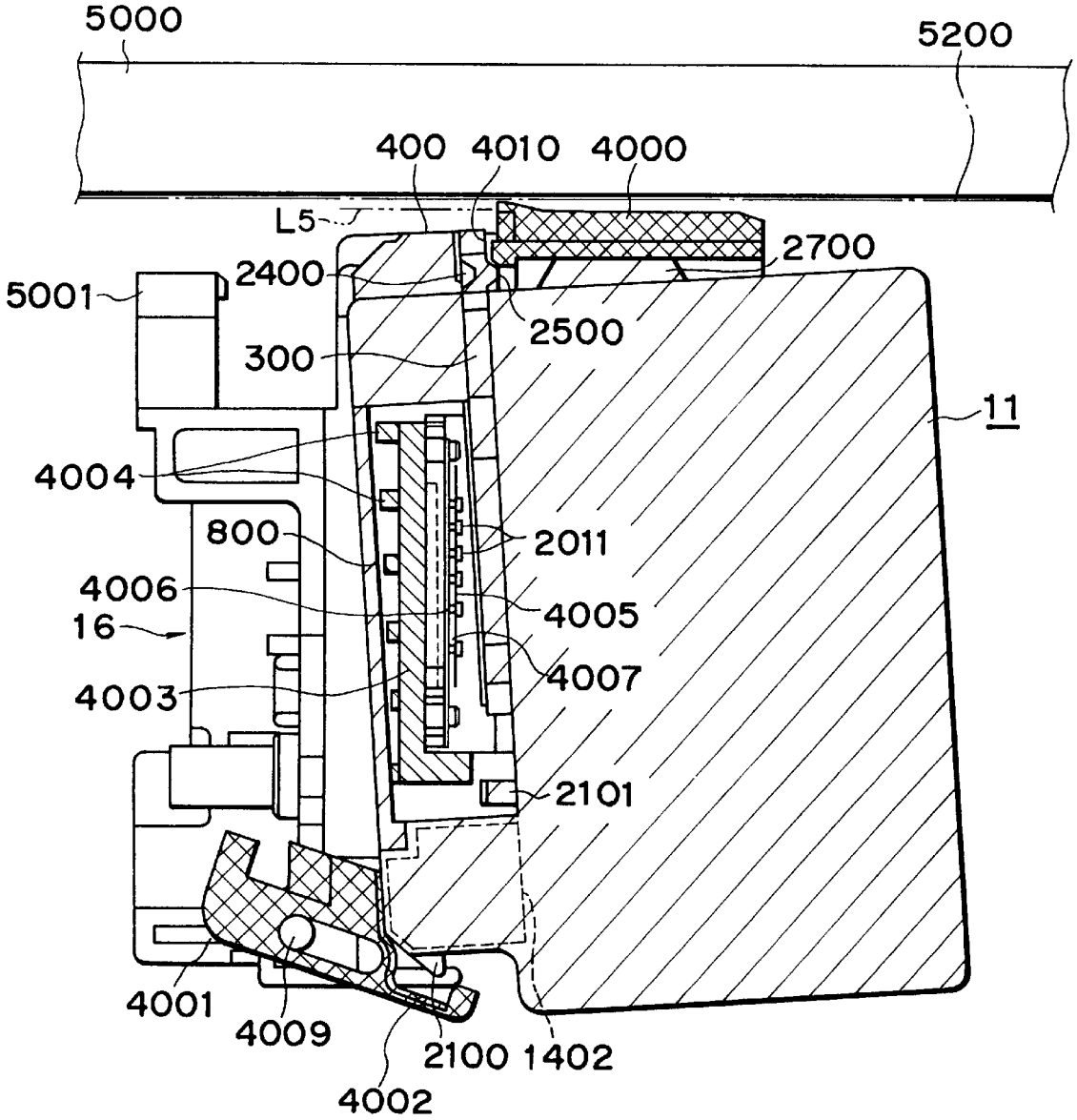
FIG. 6 is a drawing for explaining the fitting up of a head to the main body of an ink-jet recording apparatus.

The hollow portions 2400, 2400 of the support 300 are respectively made in the vicinity of the projections 2500, 2600. Therefore, in the assembled ink-jet cartridge 11 (FIG. 2), they are at the tip region of the head which is formed by parallel grooves 3000, 3001, in surrounding three sides, thereby preventing undesired matter, such as dust, and ink from reaching the projections 2500, 2600. The cover member 800 having parallel grooves 3000 forms the external wall of the ink cartridge 11, and also forms a space with the ink tank 14 for holding the ink-jet unit 13 as shown in FIG. 6. In the ink-supplying member 600 having parallel grooves 3001 formed thereon, the ink introducing tube 1600 connected to the ink supplying tube 2000 is fixed in a form of a cantilever at the side of ink supplying tube 2200. In order to secure a capillary phenomenon between the fixed side of the ink-introducing tube 1600 and the ink feeding tube 2200, a sealing pin is inserted therein. A packing 601 is employed for connection of the ink tank 14 and the ink supplying tube 2200. A filter 700 is provided at the end portion of the ink supplying tube at the side of the ink tank 14.

Since the ink-supplying means 600 is prepared by mold-forming, it is inexpensive and is positionally precise, and the production accuracy is maintained high. Owing to the cantilever structure of the ink-introducing tube 1600, the pressure-contact of the ink-introducing tube with the ink inlet 1500 is maintained even in mass production. In this example, the communication state is ensured simply by flowing a sealing adhesive from the side of the ink-supplying member 600 under the pressure contact state. The ink-supplying member 600 is readily fixed to the support 300 in such a manner that two pins (not shown in the drawing) at the back side of the ink-supplying member 600 are projected through the holes 1901, 1902 on the support 300 respectively and fusion-bonded. The small projections formed by fusion bonding are accommodated by hollows (not shown in the drawing) on the lateral side of the ink tank 14 on which the ink-jet unit 13 is attached, so that the position of the ink-jet unit 13 is precise.

The construction of the ink tank 14 is described below.

The ink tank 14 is constituted of the main body of the cartridge 1000, the ink absorbing body 900, and the cover member 1100, and is formed by inserting the ink absorbing body 900 into the main body of the cartridge 1000 from the side opposite to the ink-jet unit 13, and subsequently sealing it with the cover member 1100.

The ink-absorbing body 900 is provided for holding the ink by impregnation, and is placed in the main body of the cartridge 1000. The detail is described later. The ink supply inlet 1200 is provided to supply ink to the ink-jet unit 13, and also serves, in assembling the ink-jet cartridge 11, as an ink supply inlet for filling ink into the ink-absorbing body. The ink tank 14 has an air communication hole 1401 for communicating air to the inside, and a liquid repelling material 1400 is placed inside the air communication hole 1401 to prevent leakage of the ink therefrom.

In this example, for supplying ink satisfactorily from the ink-absorbing body 900, a continuous air space is formed in the ink tank 14 by the ribs 2300 in the main body of the cartridge 1000 and the partial rib 2310, 2320 of the cover member 1100 in the region from the air communication hole 1401 to the corner portion most distant from the ink supply inlet 1200. Therefore, ink is supplied relatively satisfactorily from the ink supply inlet 1200 to the ink absorbing body 900, which is important. This method is extremely effective practically. The four ribs 2300 are provided on the back face of the main body of the cartridge 1000 of the ink tank 14 in a direction parallel to the moving direction of the carriage 16 (FIG. 7) to prevent the close contact of the ink-absorbing body 900 with the back face. The partial ribs 2310, 2320 are placed at the positions on extension lines of the ribs 2300 respectively and on the inside face of the cover member 1100, and are in a divided state different from that of the ribs 2300, so that the air space is enlarged. The partial ribs 2310, 2320 are distributed in the area not more than half of the area of the cover member 1100. The ribs make it possible to introduce the ink by capillary force to the ink supply outlet 1200 from the farthest corner portion.

The aforementioned constitution and the arrangement of the ribs are particularly effective for the above ink tank 14, which has an ink holding space in a form of a rectangular solid having its long side on the side face. In the case where the rectangular solid has its long side along the direction of moving a direction of the carriage 16 (FIG. 7), the ink supply from the ink-absorbing body can be stabilized by providing the ribs over the whole face of the cover member 1100. The rectangular solid form is suitable for holding ink as much as possible in a limited size of space. In order to use the stored ink effectively for recording without loss, the ribs playing the above role are preferably provided on two face regions neighboring to the corner portion. Further, the inside ribs of the ink tank 14 in this example are distributed uniformly in the thickness direction of the ink-absorbing body 900 in a rectangular solid form. This constitution enables maximum utilization of the substantially entire ink in the ink-absorbing body 900 by uniformizing the atmospheric pressure distribution. The distribution of the ribs is based on the technical idea below. When the position of the ink supply inlet 1200 is projected onto the rectangular upper face of the rectangular solid and a circle is drawn with the projected position as a center with a radius of the length of the long side of the rectangle, it is important to provide the ribs at the area outside the circle line in order to give early the atmospheric pressure state. In this case, the position of the air hole of the ink tank is not limited to that in this example provided that the air is introduced to the rib-distributed region.

In this example, the back side of the ink cartridge 11 opposite to the ink-jet head 12 is made planar to minimize the necessary space when incorporated in the apparatus and to maximize the quantity of the ink held therein, whereby the apparatus can be miniaturized and the frequency of cartridge exchange is decreased desirably. Behind the space for integrating the ink-jet unit 13, a projection of the air hole 1401 is formed and the inside of the projected portion is made vacant to form an atmospheric pressure supplying space 1402 for an entire thickness of the ink-absorbing body 900. Such constitution gives an excellent ink-jet cartridge which has never been met. This atmospheric pressure supplying space 1402 is much larger than conventional ones, and the air communication hole 1401 is placed at a higher position. Therefore, if the ink come off from the ink-absorbing body 900, this atmospheric pressure supplying space 1402 is capable of retaining the ink temporarily, enabling steady recovery of the ink to the ink-absorbing body 900, thus providing an efficient and excellent cartridge.

Figure 5:
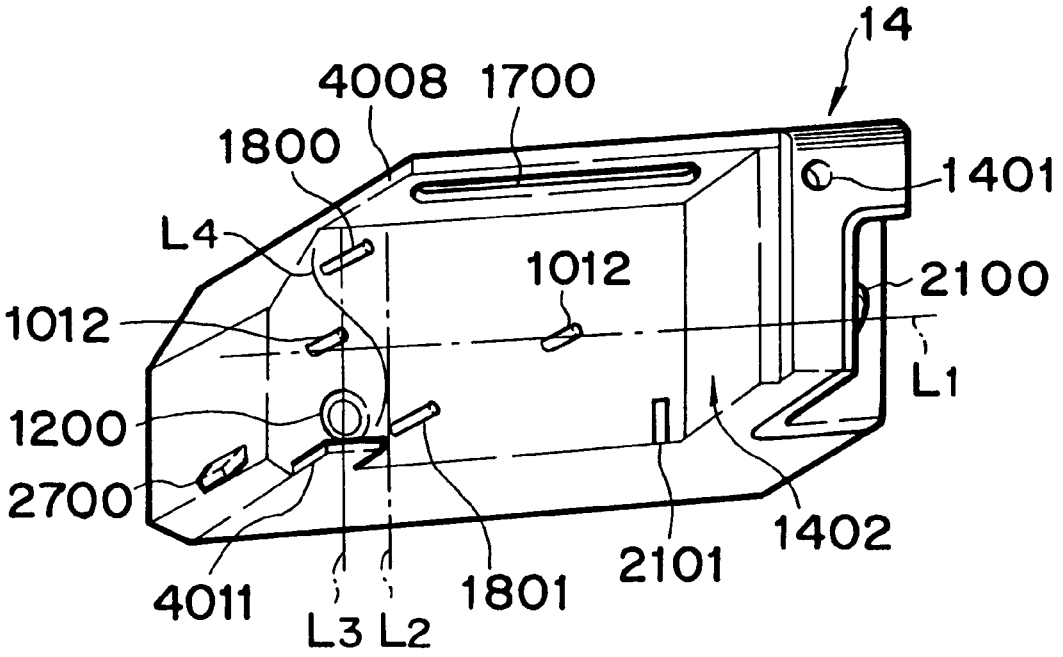
FIG. 5 is a rough drawing of a lateral side of the head portion.

The constitution of the face of the ink tank 14 on which the ink-jet unit 13 is attached is shown in FIG. 5. Two projections 1012 for registration engaging with the holes 312 on the support 300 is on a straight line $L_1$ which passes near the center of the ejection outlet of the orifice plate 400 and is parallel to the bottom face of the ink tank 14 or a base face of the mounting of the carriage 16. The height of the projection 1012 is slightly less than the thickness of the support 300, and registers the support 300. On the extension line of $L_1$ in this drawing, a claw 2100 is provided which engages with an engaging face 4002 perpendicular to the hook 4001 for registering the carriage 16 as shown in FIG. 5. Thus the force for registering the carriage 16 is exerted in a planar region parallel to the base face containing the line $L_1$. As mentioned later, such construction relation is effective since the accuracy of registration of the ink tank 14 itself is nearly equal to the accuracy of the positional registration of the outlet of the ink-jet head 12.

The projections 1800, 1801 of the ink tank 14 corresponding respectively to the holes 1900, 2000 on the support 300 for fixing it to the side face of the ink tank 14 are longer than the aforementioned projection 1012, and are utilized for fixing the support 300 by bonding by fusion of the portion projecting through the support 300. On a line $L_3$ perpendicular to the above-mentioned line $L_1$ and passing the projection 1800, approximate center of the ink supply inlet 1200 is placed. Thereby the bonding of the ink supply inlet 1200 with the ink supply tube 2200 is stabilized, and a load caused by dropping, or impact exerted on the bonding portion, is reduced. The line $L_2$ passes the projection 1801. The lines $L_2$ and $L_3$ do not coincide with each other. The projections 1800, 1801, also serve for registering the ink-jet head 12 relative to the ink tank 14. The curve $L_4$ denotes a position of the outside wall when the ink supplying member 600 is mounted. The projections 1800, 1801 are arranged along the curve $L_4$, which give sufficient strength and positional precision against the weight of the construction of the tip portion of the ink-jet head 12. The tip collar 2700 of the ink-jet head 12 is inserted into the hole of the front plate 4000 (FIG. 6) of the carriage 16, to meet abnormalities such as extreme displacement of the ink tank 14. The stopper 2101 for preventing slipping from the carriage 16 is provided to fit a bar (not shown in the drawing) of the carriage 16, and is a protecting member for maintaining the mounted state when the ink-jet cartridge 11 comes under the bar at the position where cartridge 11 had been mounted and receives a vertical force to displace it from the determined position.

The ink-jet unit 13 is fitted up to the ink tank 14, and then covered with the cover member 800 to enclose the ink-jet unit 13 for except the bottom opening portion. The ink-jet cartridge 11, however, is mounted on the carriage 16, and the bottom opening comes close to the carriage 16, substantially forming a four-side-enclosed space. Although the enclosed pace serves effectively for thermal insulation for heat generated by the ink-jet head 12, slight temperature elevation will be caused in over a long time of running. As the counter-measure thereto in this example, a slit 1700 is provided which has a smaller width than the enclosed space to prevent temperature elevation and simultaneously make uniform the temperature distribution throughout the the entire ink-jet unit 13 independently of the environment.

After the ink-jet cartridge is assembled, the ink is supplied to the ink supplying member 600 from the interior of the main body of the cartridge 1000 through the ink supply inlet 1200, the hole 320 on the support 300, and an introducing opening at the back side of the ink supplying member 600, and then flows into the common liquid chamber through an outlet hole, a suitable supply tube, and the ink inlet 1500 on the cover plate 1300. The ink supply path is ensured by sealing with packings made of silicone rubber, butyl rubber or the like.

As described above, the ink supplying member 600, the cover plate 1300 with the orifice plate 400, and the main body of the cartridge 1000 are respectively molded as an integrated part, which makes the assemblage precise and is effective in high-quality mass production. The number of parts is fewer than conventional products, so that the intended superior characteristics are surely obtained.

In the assembled ink-jet cartridge 11 in this example, a slit 1701 is provided between the upper face 603 of the ink-supplying member 600 and the end portion 4008 of the roof portion having a long and narrow opening 1700 of the ink tank 14 as shown in FIG. 2. Similarly, a slit (not shown in the drawing) is formed between the bottom face 604 of the ink-supplying member 600 and a head-side end portion 4011 of the thin plate member adhered to the cover member 800 at the lower portion of the ink tank 14. These slits accelerate the heat release from the aforementioned opening 1700, and will prevent any direct action of force to the ink-supplying member 600 or the ink-jet unit 13 if unnecessary force is exerted to the ink tank 14.

As described above, the construction of the present invention is novel. Not only each of the construction units is effective individually, but also the combination thereof is particularly effective.

The mounting of the ink-jet cartridge 11 on the carriage 16 is explained below.

In FIG. 6, the platen roller 5000 guides the recording medium 5200 (e.g., recording paper) from the back side of the plane of the drawing to the front side thereof. The carriage 16, which moves along the length direction of the platen roller 5000, is provided with a front plate 4000 (2 mm thick) in the front side of the carriage 16, namely the platen roller side, a supporting plate 4003 for electric connection described later, and a registering hook 4001 for fixing the ink-jet cartridge 11 at a predetermined recording position. The front plate 4000 has two projected faces 4010 for registration corresponding to the projections 2500, 2600 of the support 300 of the ink-jet cartridge 11, and receives a force perpendicular to the projected face 4010 after the ink-jet cartridge 11 is mounted. Therefore, a plurality of strengthening ribs (not shown in the drawing) are provided on the platen roller 5000 side of the front plate 4000. These ribs also form head-protecting projection portions which project slightly (about 0.1 mm) from the front face position $L_5$ of the mounted ink-jet cartridge 11 toward the platen roller 5000. The supporting plate 4003 has a plurality of strengthening ribs 4004 which are directed perpendicular to the plane of the drawing. The projection length of these ribs decreases from the one at the platen roller 5000 side to the one at the hook 4001 side, whereby the ink-jet cartridge 11 is mounted obliquely as shown in the drawing. The supporting plate 4003 has a flexible sheet 4005 provided with pads 2001 corresponding to the pads 201 on the wiring base board 200 of the ink cartridge 11, and a rubber pad sheet 4007 with botches for giving elasticity for pressing the flexible sheet to each a pads 2011 from the back side. For stabilizing the electric contact between the pads 201 and the pads 2011, the supporting plate 4003 has a registration face 4006 at the hook 4001 side which exerts a force to the ink-jet cartridge 11 in a direction reverse to the exertion direction of the above projected face 4010. Pad contact is made therebetween, and the deformation of the botches of the rubber sheet 4007 corresponding to the pads 2011 is decided definitely. When the ink-jet cartridge 11 is fixed at the recording position, the registration face 4006 is in contact with the surface of the wiring base board 200. Since the pads 2011 are distributed symmetrically regarding the aforementioned line $L_1$, the rubber pad sheet 4007 having botches is deformed uniformly, and the contact pressure between the pads 2011 and the pads 201 is stabilized. In this example, the distribution of the pads 201 is in two lines vertically and in two lines laterally.

The hook 4001 has a long slit for engaging with a fixing axis 4009. After counterclockwise rotational movement from the position shown in the drawing by utilizing the moving space, the ink-jet cartridge 11 is registered relative to the carriage 16 by movement to left along the length direction of the platen roller 5000. The movement of the hook 4001 may be made in any manner, but preferably made by a lever manipulation. In any way, in the rotational movement of the hook 4001, the ink cartridge 11 moves toward the platen roller 5000 side to the position where the registering projections 2500, 2600 can come into contact with the projected face 4010 of the front plate 4000. By the lefthand movement of the hook 4001, with hook face at 90° being kept in close contact with the 90° face of the claw 2100 of the ink-jet cartridge 11, the ink-jet cartridge 11 rotates horizontally around the contact region of the projection 2500 with the projection face 4010, finally causing the contact of pads 201 with pads 2011. When the hook 4001 is to be held at the predetermined position, or a fixing position, the complete contact of the pads 201 with the pads 2011, facial contact of projections 2500, 2600 with the projected face 4010, and facial contact of the hook face 4002 with the 90° face of the claw are realized, thus finishing the mounting of the ink-jet cartridge 11 on the carriage 16.

An outline of the main body of the ink-jet recording apparatus is explained below.

Figure 7:
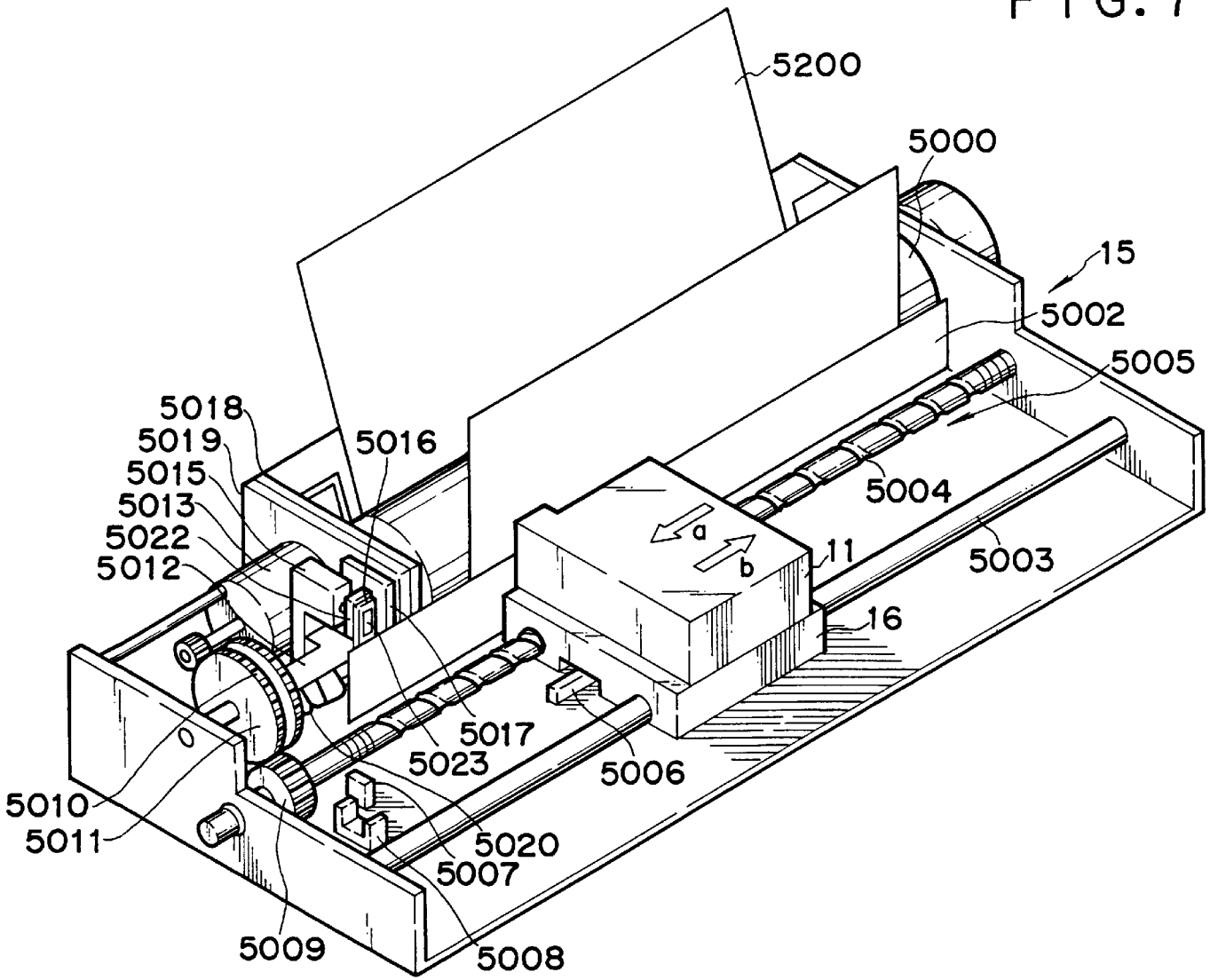
FIG. 7 is a perspective view of a recording apparatus provided with a head of the present invention.

An appearance of an ink-jet recording apparatus applicable in the present invention is shown in FIG. 7. A leading screw 5005 having a spiral groove 5004 is driven to rotate in normal or reversed direction by interlocking with a driving motor 5013 through driving force-transmitting gears 5011 and 5009. The carriage 16 is engaged with the spiral groove 5004 by a pin (not shown in the drawing) at the mounting portion 5001 (FIG. 6), and is guided slidably by a guiding rail 5003 to move in the direction shown by arrow marks a and b reciprocally. A paper-pressing plate 5002 pushes and presses a recording medium 5200 toward the platen roller 5000 throughout the moving direction of the carriage 16. Photocouplers 5007, 5008 constitutes a home-position-detecting means to confirm the position of the lever 5006 of the carriage 16 to be within the region and to control the driving direction, etc. of the driving motor 5013. A capping member 5022 for capping the front face of the ink-jet head 12 is supported by the supporting member 5016 and has a suction means 5015 for recovering the suction of the ink-jet head 12 through an opening 5023 in the cap. The main-body-supporting plate 5018 has a supporting plate 5019. A cleaning blade 5017 supported slidably by the supporting plate 5019 is driven forward and backward by a driving means not shown in the drawing. The shape of the cleaning blade 5017 is not limited to the one shown in the drawing, but a variety of known shapes of blades are applicable in the present example. The lever 5012 is provided to start the suction-recovery operation, moving with the movement of a cam 5020 engaging with the carriage 16. The movement is caused by the driving force of the driving motor 5013 transmitted by a known transmitting means such as a gear 5010, a shift clutch, and the like.

The respective operations of capping, cleaning, and suction recovery are conducted at the corresponding site by action of the leading screw 5005 when the carriage 16 comes to the home position. Any of the operations are applicable in the present invention, if the operations are conducted at a known timing and with a desired manner. The respective constructions are superior separately or combined, and are preferred in the present invention.

Figure 1B:
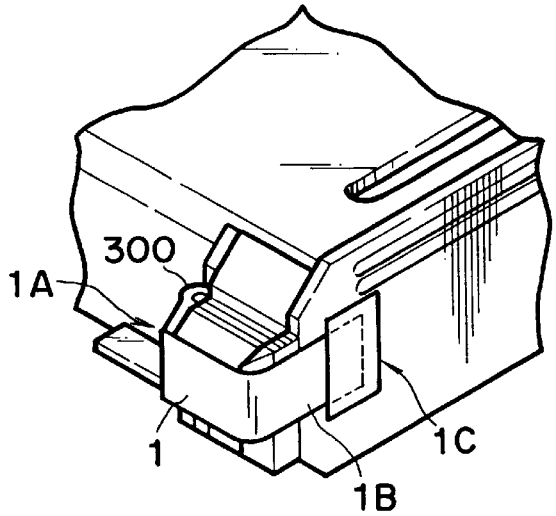
Figure 1C:
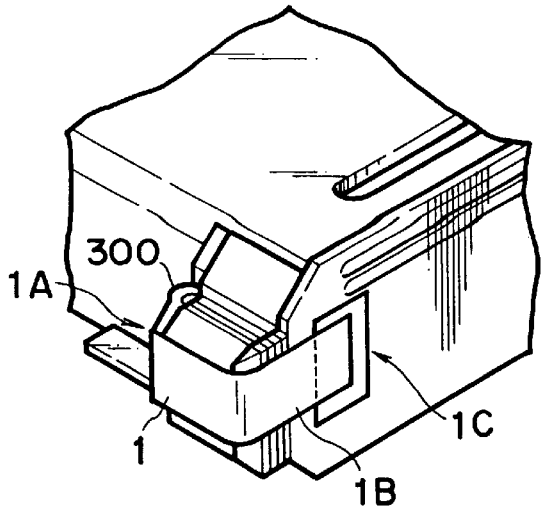

FIGS. 1A to 1C illustrate a partial perspective view of a portion where a seal tape constructed of a support of the sealing member and an adhesive layer is bonded to a plurality of ejection outlets (as shown in FIG. 2) and a stepped face extending from the support 300 to the cover member 800 in a direction vertical to the arrangement of the outlet through the adhesive layer of the seal tape. The seal tape 1 comprises a portion 1A to be bonded to the support 300 and a portion 1B to be in close contact with the ejection outlet face and to be bonded to the cover member 800. (In this example, the face itself is also an irregular face.) In FIG. 1A, the seal tape is folded back and the portions of the adhesive are made to adhere together to provide a lug 1C, whereby the finger grip portion is simplified in construction and is easily provided. In FIG. 1B, a separate pressure-sensitive adhesive tape is further applied on the seal tape to fix it more tightly. Alternatively in FIG. 1C, a piece of paper or a film is used as the finger grip by utilizing the adhesiveness of the adhesive portion of the seal tape, whereby the cost is lower than that of FIG. 1B.

In any constitution, it is important to provide sufficient effect of the seal tape for preventing the ink leakage from the ejection outlet.

The evaluation criterion according to the load at a yield point (or a yield load) is explained by reference to experimental results.

The measurement conditions are explained below for the seal tape having the pressure-sensitive adhesive portion as the sealing member. The present invention has been accomplished based on the finding that the yield load shows the overall properties of the sealing material more precisely, if it is measured with a test specimen of 10 mm wide at a stress rate of 200 mm/min±10% according to JIS-K-7113.

EXAMPLE 1

A Seal Tape 1 was prepared as below. A non-stretched polypropylene film of 30 $\mu$m thick was used as the support. The adhesive-applying surface was subjected to corona discharge treatment, and thereon the acrylic pressure-sensitive adhesive was applied.

Pressure-sensitive adhesive composition

| | |
|---|---|
| Butyl acrylate | 80 parts by weight |
| Acrylonitrile | 10 parts by weight |
| 2-Hydroxyethyl acrylate | 10 parts by weight |

These substances were polymerized with a benzoyl peroxide catalyst in a solution in a mixed solvent composed of toluene and butyl acetate (50:50 in volume ratio) at 85° C. for 8 hours to obtain a copolymer having a weight-average molecular weight of 300,000. The copolymer was precipitated from ethanol to eliminate residual monomers and a low polymer with the solvent, and then the copolymer was dried. The resulting copolymer was again dissolved in a mixed solvent of toluene and ethyl acetate (50:50 in volume), and thereto, dicyclohexylmethane diisocyanate was added in an amount of 10.1 g per 100 g of the copolymer to obtain a coating liquid. This coating liquid was applied on the above support to give a dry thickness of 30 μm, dried by heating at 60° C. for 10 minutes, and further aged at a room temperature for one week. Thus the Seal Tape A was prepared.

EXAMPLE 2

The Seal Tape B was prepared in the same manner as the Seal Tape A except that the dicyclohexylmethane diisocyanate was added in an amount of 2.5 g.

EXAMPLE 3

The Seal Tape C was prepared in the same manner as the Seal Tape B except that the support employed was a non-stretched polypropylene film of 20 μm thick.

EXAMPLE 4

The Seal Tape D was prepared in the same manner as the Seal Tape B except that the support employed was a polyvinylidene chloride of 30 μm thick.

EXAMPLE 5

The Seal Tape E was prepared in the same manner as the Seal Tape B except that the support employed was a non-stretched polypropylene film of 20 μm thick containing titanium oxide.

EXAMPLE 6

The Seal Tape I was prepared in the same manner as the Seal Tape A except that the support employed was a non-stretched polypropylene film of 32 μm thick.

EXAMPLE 7

The Seal Tape J was prepared in the same manner as the Seal Tape B except that the support employed was a non-stretched polypropylene film of 25 μm thick containing titanium oxide.

Comparative Example 1

The Seal Tape F was prepared in the same manner as the Seal Tape A except that the support employed was a non-stretched polypropylene film of 40 μm thick.

Comparative Example 2

The Seal Tape G was prepared in the same manner as the Seal Tape B except that the support employed was a non-stretched polypropylene film of 30 μm thick containing titanium oxide.

Comparative Example 3

The Seal Tape H was prepared in the same manner as the Seal Tape B except that the support employed was a polyethylene terephthalate film of 25 μm thick.

Evaluation methods

1. Adhesive Strength (gf/25 mm)

The Seal Tapes A to J were tested according to the adhesive strength measurement of JIS-Z-0237.

The test plate employed was made of stainless steel (SUS304). The peeling rate was 300 mm/min.

2. Yield Load (kgf/cm)

The Seal Tapes A to H were tested according to the aforementioned JIS-K-7113.

The test specimen was 10 mm wide, and the stress rate was 200 mm/min.

3. Ink Leakage

The ink-jet recording head was employed which has 64 nozzles at a nozzle spacing of 16 nozzles per mm. The ink having the composition below was filled in the ink-jet recording head, and the Seal Tapes A to H were applied to stick to the nozzle surface.

Ink Composition

| | |
|---|---|
| C.I. Food Black 2 | 2 parts by weight |
| Glycerin | 10 parts by weight |
| Urea | 5 parts by weight |
| Isopropyl alcohol | 5 parts by weight |
| Water | 78 parts by weight |

The ink-jet recording heads with the seal tapes applied were placed in a heat cycle tester, and were exposed to 10 heat cycles: one cycle consisting of −30° C. for 2 hours, room temperature for 2 hours, and 60° C. for 2 hours. After the test, the nozzle surfaces having the seal tapes applied thereon were observed. The evaluation results are shown in Table 1 where the symbol "X" denotes that ink leaked out from the seal tape, and the symbol "○" denotes that the ink did not leaked out.

TABLE 1

| Example No. | | Adhesive strength (g/25 mm) | Yield load (kgf/cm) | Prevention of ink leakage |
|---|---|---|---|---|
| Example | 1 | 430 | 0.9 | ○ |
| | 2 | 600 | 0.9 | ○ |
| | 3 | 550 | 0.6 | ○ |
| | 4 | 500 | 0.4 | ○ |
| | 5 | 590 | 0.7 | ○ |
| | 6 | 450 | 1.0 | ○ |
| | 7 | 620 | 1.0 | ○ |
| Comparative example | 1 | 540 | 1.2 | × |
| | 2 | 640 | 1.3 | × |
| | 3 | 1100 | 2.7 | × |

As shown above, according to the evaluation criterion of the yield load, the ink leakage is prevented when the yield load is not more than 1.0 kgf/cm.

Further study was made in particular regarding the case where the above seal tape is applied to a stepped surface. Consequently, another preferable evaluation criterion was found in which measurement is conducted as shown in FIG. 8A and FIG. 8B and described below.

That is, the inventors of the present invention have found a property useful as an evaluation criterion for peeling of a pressure-sensitive adhesive portion on a stepped surface after long term of standing. FIG. 8A and FIG. 8B are rough drawings for explaining the above evaluation criterion. In the drawings, the holder T2 made of polysulfone holds a specimen T3 to be tested. The holder T2 may be of any material if it is capable of holding the specimen T3 without deformation thereof. In this example, the holder T2 holds the specimen T3 at its pressure-sensitive adhesive portion 1D by its adhesiveness. The holder T2 is rotatable at the supporting point around the rotation axis T7, and is movable in a direction parallel to the horizontal pan face of the electronic balance T5. The moving distance is made to be 5 mm. The width of the specimen T3 is not limited, but the standard width is 10 mm. The measured value is converted to the standard width in proportion to the width of the specimen to enable comparison of the folding load.

Figure 8A:
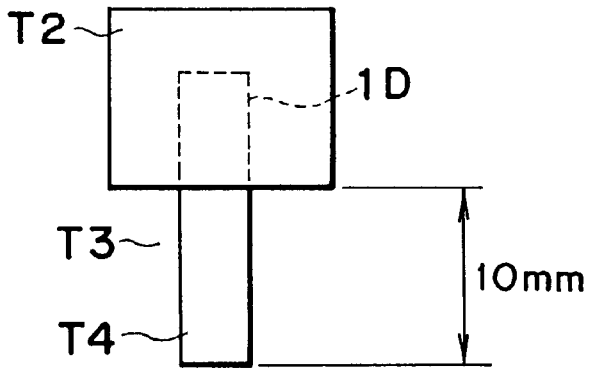
FIG. 8A and FIG. 8B are rough drawings illustrating an example of a seal tape of the present invention, and a coating process.
Figure 8B:
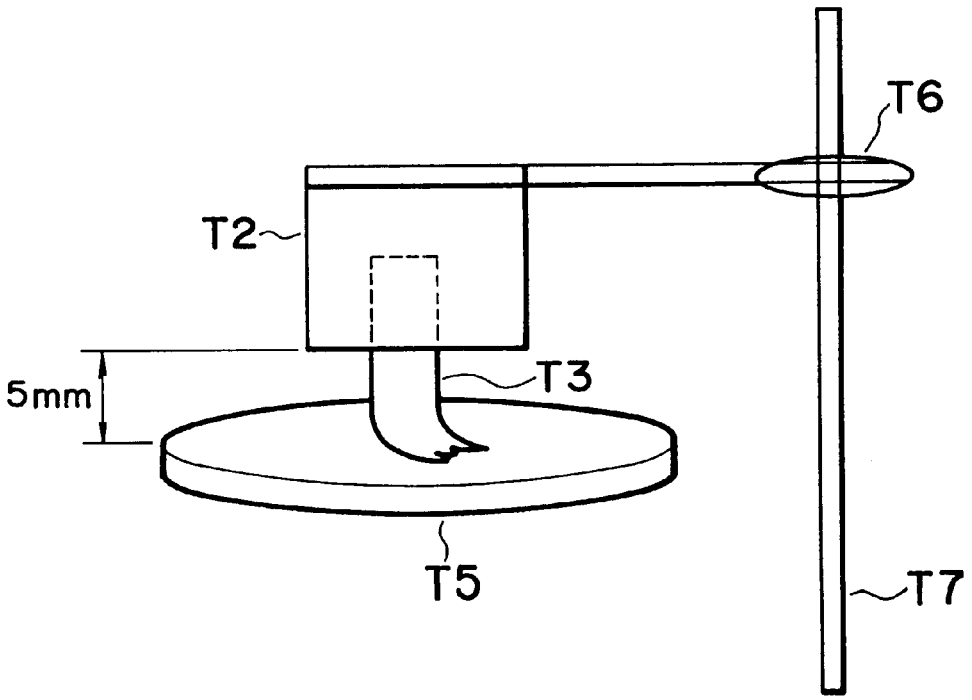

In the measurement, as shown in FIG. 8A, a test specimen T3 of the sealing member having the pressure-sensitive adhesive portion is bonded to the polysulfone plate T2 such that the free length T4 is 10 cm long. Then the non-adhesive side (or the support side) of the specimen T3 is slid on the electronic balance pan surface by adjusting the aforementioned distance to 5 mm, and stopped at the center of the pan. The load is read immediately, and the measured load is converted to the load per 10 mm, if the width of the specimen is not 10 mm, the converted value of the load per 10 mm showing the folding load of the present invention.

The specimens of the above-described Examples and Comparative Examples were tested for the folding load. The results are shown in Table 2.

TABLE 2

| Example No. | | Adhesive strength (g/25 mm) | Folding load (g/cm) | Prevention of ink leakage |
|---|---|---|---|---|
| Example | 1 | 430 | 0.05 | ○ |
| | 2 | 600 | 0.05 | ○ |
| | 3 | 550 | 0.01 | ○ |
| | 4 | 500 | 0.01 | ○ |
| | 5 | 590 | 0.02 | ○ |
| | 6 | 450 | 0.08 | ○ |
| | 7 | 620 | 0.07 | ○ |
| Comparative example | 1 | 540 | 0.12 | × |
| | 2 | 640 | 0.11 | × |
| | 3 | 1100 | 0.32 | × |

Further, various samples were prepared and tested. As the results, the samples exhibiting a folding load of 0.1 g did not cause ink leakage immediately after the experiment, but caused slight peeling after several hours. Such samples were found to be useful practically. However, the folding load of 0.08 g or lower was more preferable. Naturally, it is desirable that the sealing member satisfies simultaneously the aforementioned condition of the yield load of not more than 1.0 Kg/cm in addition to the above condition of the folding load.

As the evaluation criterion, the folding load is preferable in the present invention. The sealing member gives an extraordinary effect when it exhibits a folding load of not more than 0.10 g per cm of width at the center of an electronic balance pan at a distance of 5 mm from the end of the holder.

Next, the air communication structure is explained which is greatly effective in the present invention.

Briefly, the ink container has an air communication device to make the inside thereof open to the outside air. The air communication device has a plurality of cells through which the inside room communicates with the outside. The opening of the respective cells is smaller in comparison with the size of the cell. The plurality of cells, which are larger in size in comparison with the openings, are placed sequentially and communicate through the small openings, so that the ink leakage is checked a plurality of times, and the ink coming out has to pass the plurality of holding spaces to reach the outside. Therefore, the effect of preventing ink leakage is remarkable in comparison with the conventional ink container. With the plurality of cells, evaporation of ink is reduced greatly even though the small spaces are saturated with water vapor in an early stage. Furthermore, the openings of the cells are shifted positionally from each other, the ink intruded by shock or swing is dispersed, whereby the small spaces prevent the ink leakage effectively.

Another construction of the device, in which the plurality of the cells is placed in a crossed direction from the inside to the outside, may also disperse ink intruded therein by shock or swing, thereby the ink leakage being prevented effectively, and miniaturization of the air communication device being possible advantageously. Although this construction is effective singly, the combination thereof with the aforementioned construction improves the effect synergistically. Further, if the cells are sequentially made larger from the outside to the inside, the buffering action is made larger for the given space size and ink leakage is more effectively prevented.

On the other hand, when a member exists which is continuous to the inner wall in the vicinity of the communication device, the placement of the air communication device in the inside of the ink container may cause another problem that the ink may spread along the member connected to the inner wall. This ink spreading is more surely prevented with the above construction than with conventional construction. If this phenomenon can be avoided, the effect of the present invention is more reliable for a long term. Accordingly, in a preferred constitution of the present invention, the end of the opening is protruded to the inside relative to the continuous member. In such a case, it is preferred that the end of the opening does not come into contact with the ink absorption body like a porous sponge.

Figure 9:
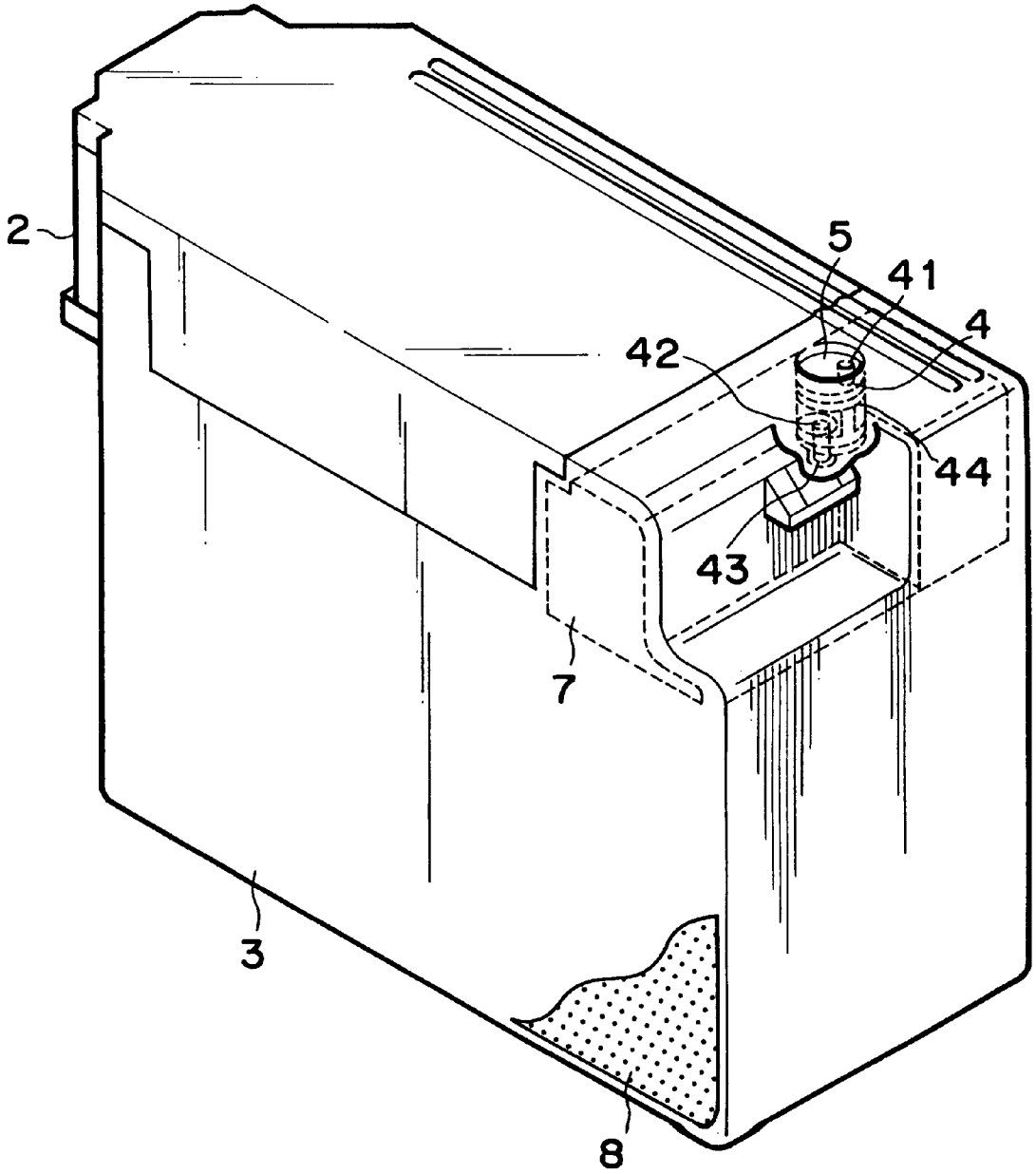
FIG. 9 illustrates an air communication hole of a head of the present invention.
Figure 10:
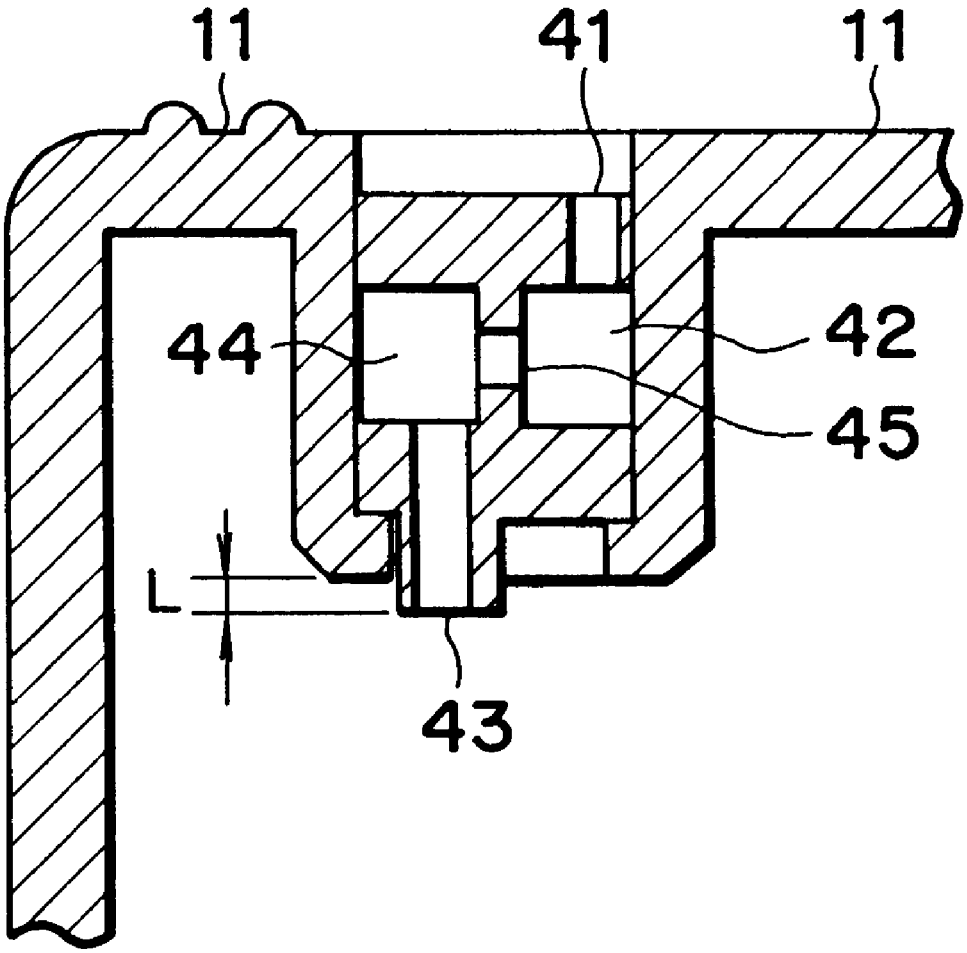
FIG. 10 illustrates a shape of the air communication hole.

FIG. 9 illustrates the construction of the air communication device of a recording cartridge perspectively. The recording cartridge comprises a recording head 2 for ejecting liquid droplets in accordance with electric signals; a tank 3 for storing a recording liquid to be supplied to the recording head 2; an air communication device 4 for equalizing the internal pressure in the tank 3 to the atmospheric pressure; a cap member 5 forming the air communication opening and a plurality of cells; a porous matter 8 for holding the recording liquid; and a buffer chamber 7 for preventing ink leakage caused by variation of temperature and atmospheric pressure, corresponding to the aforementioned atmospheric pressure-supplying space 1402 and separating the air communication device from the porous matter 8. FIG. 10 illustrates the detail of the construction of the air communication device of FIG. 9 by a cross-sectional drawing of the opening portion. As understood from these drawings, the air communication device is constructed from an inner opening 43, an inner cell 44, an opening 45 between the cells, an outer cell 42, and outer opening 41, communicating in this order toward the atmospheric air. In this example, the cap member as shown in the drawing is inserted into the cylindrical inner wall 11 of the ink tank by deforming a projection (like a burr deformable by pressing in a size of about 0.1 mm) of the cap member to form the air communication device. In another example, a construction satisfying the same object may be fixed on the outer wall of the ink tank.

The air communication device has a pipe-shaped opening directed to the inside of the ink tank, and has a partition plate to form two cells when fitted to the cylindrical opening of the tank housing. A hole is provided on the partition plate to communicate between the two cells. One of the two cells is open to the inside of the ink tank, and the other cell is open to the external atmospheric air. The pipe-shaped opening is attached so as to direct to the inside of the ink tank. The respective openings are positioned at the gravitational center of the plane facing to the cells. The hole on the partition plate is also positioned preferably at the gravitational center of the partition plate. The inside diameter is preferably in the range of from 0.5 mm to 1.0 mm. In this example, each of the openings has a diameter of 0.8 mm. The outermost opening 41 has preferably a smaller diameter than that of the inside openings. In this example, the diameter of 0.7 mm is the most suitable.

FIG. 10 illustrates a cross-sectional diagram of the cap member fitted to the ink tank housing. The pipe-shaped opening has a protruding portion having a length L (preferably not less than 5 mm).

FIG. 12A, FIG. 12B, and FIG. 12C are shown to explain an ink recorder having a sealing portion formed by fitting a sealing member in the opening of the container having ink therein, wherein the opening is constructed from a deformable resin material, and the sealing member is a ball to close the opening by pressing and deforming the resin material. By employing such constitution exhibiting an effect of preventing ink evaporation in addition to the structure of the present invention, the advantage of the recording head of the present invention is further enlarged. FIG. 12A illustrates a cross sectional view of the ink-feeding path in a bent form having an opening 602B. FIG. 12B illustrates a ball 602A to be pressed in. FIG. 12C illustrates a sealed state. In this example, an approximately L-shaped ink feeding path (FIG. 12A) is constructed from a fixed side of an ink tube 1600 and an ink feeding tube 2200 which are shaped integrally from a resin. The opening 602B is an opening for degassing at the integral shaping. To this opening, the pressing ball 602A is pressed in, which has a slightly larger diameter than the minimum inner diameter of the opening, so that the resin deforms to seal the opening surely with the ball.

In this example, not only the sealing ball serves to seal the opening, but also the capillary phenomenon is ensured between the ink path 1600 and the ink-supplying tube 2200 by decreasing the sectional area at the bent portion from the ink-supplying tube 1200 to the ink path 1600. Thus the application of a sealing member in a spherical form gives advantage an of stabilizing the ink flow without disturbing the ink flow.

The examples of the numerical values are shown specifically. In FIG. 12A, the end portion of the ink supplying tube 2200, which is pressed to an ink absorbing member in the ink tank to supply ink to the recording head in correspondence with the consumption of the ink, has an inner diameter of 2.0 mm. The ink path 1600 has an inner diameter of 1.5 mm with tolerance of not less than −0.08 mm and not more than −0.05 mm, and has a supplying tube of 1.0 mm in inner diameter for supplying ink to a common liquid chamber of the recording head at the other end opposite to the ink supplying tube 2200. Accordingly, the minimum diameter of the opening is 1.5 mm with the tolerance of not less than −0.08 mm and not more than −0.05 mm, and the front side of the opening 602B is tapered so as to readily insert a ball-shaped sealing member corresponding to 2.1 a mm diameter. The ball 602A of FIG. 12B to be pressed in has a diameter of 1.5 mm±0.02 mm, and is a rigid metal ball such as of stainless steel, aluminum, and iron. When the ball 602A is pressed into the minimum diameter portion, the ink path 1600 made of a resin is only slightly deformed, and gives the sealed state as shown in FIG. 12C. The ball itself may be made of a resin. However, the ball is preferably more rigid than the opening portion. In consideration of the evaporation of the ink, a metal ball is preferred. The pressure-contact of the metal with a resin gives a relatively stable sealing state for a long term independently of variation of environmental conditions. A stainless ball is particularly suitable as the results of the test for the resistance against ink at 80° C. for two month storage.

The degree of pressing-in of the ball 602A may be at any level, if the sealing can be achieved. In this example, the entire of the ball 602A is placed behind the face of the ink-feeding tube 2200 in order to avoid the possibility of displacement of the ball by contact with other constitutional member and to simplify production without production variation.

The constructions of FIG. 9, and FIGS. 12A to FIG. 12C were applied to the present invention to provide a constitution simplifed yet superior in overall functionality, and evaluated from various view points. The constitution was found to have advantages of satisfactory maintenance of ejecting outlet face of the recording head, removal of inconvenience at the start of recording, prevention of ink evaporation, maintenance of recording properties during standing, from selling to use and standing left, and was excellent in overall evaluation.

Figure 11:
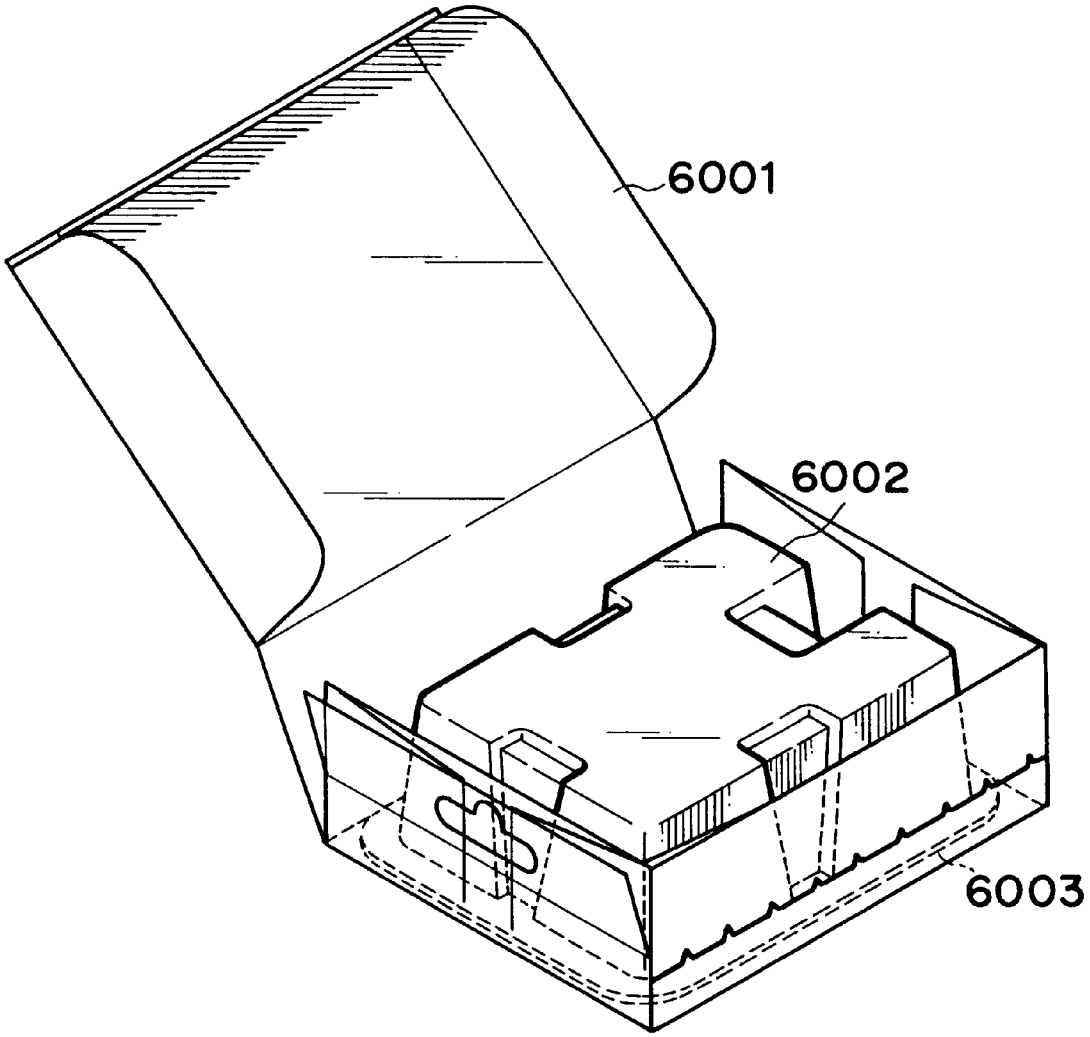
FIG. 11 illustrates a state of package of a cartridge of the present invention.

The package of FIG. 11 is explained briefly. The evaporation is less by a factor of about 0.6 than that in conventional ones. Thereby, the printing amount is increased for the same amount of packed ink, and the freedom of selecting the package material is increased. Thus the thickness of the package can be decreased, for example, from 1 mm to 0.6 mm. By decreasing the thickness, the material cost can be decreased and the productivity can be raised. Furthermore, while one layer of aluminum foil is used at the cover side conventionally, the foil can be replaced by aluminum vapor-deposition film. Thus production steps are reduced, which makes the cost lower.

An example of a package having the communication opening is shown below.

Package Example

| | | | |
|---|---|---|---|
| Package wrapping material 6002: | Thickness | 0.6 | mm |
| Package cover 6003: (Layer constitution) | Outermost layer: | PET 12 | μ |
| | Aluminum | 0.05 | μ |
| | Nylon | 15 | μ |
| | PE | 25 | μ |
| | EVA peeling layer | 25 | μ |

The ink jet cartridge is placed in the above package, and further packed in the packing box 6001.

As described above, the sealing constitution of the present invention achieves simplification of the constitution, and exhibits synergistic effects in combination with other novel constitution, which is significant industrially.

The protecting seal tape as the sealing member of the present invention is capable of keeping sufficient adhesiveness even on a irregular surface like a face of an ejecting outlet of an ink-jet recording head, and, when applied to the ejection outlet, is capable of protecting the ejection outlet and preventing the leakage of ink from the ejection outlet during a long term of storage.

Furthermore, the protecting seal tape having a preferred pressure-sensitive adhesive is peelable readily on use of the ink-jet recording head after a long term of storage without soiling of the ejection outlet of the ink-jet recording head and in the vicinity thereof and achieving the protection without adverse effect on ink-jet recording.

The above object is achieved by using only the tape of the present invention without the use of another protecting member (such as a pushing member for preventing peeling-off of the sealing tape).

What is claimed is:

1. A sealing member, comprising a film portion and an adhesive portion, for sealing with said adhesive portion a communicating hole or a joint portion between an interior and an exterior of a recording/container unit containing an ink, said film portion having a thickness in a range of 30$\mu$ to 100$\mu$ and said adhesive portion having a dry thickness in a range of 30$\mu$ to 100$\mu$, said adhesive portion being pressure-sensitive, and a yield point being exhibited at a load less than or equal to 9.81N/cm for a specimen 10 mm wide at a stress rate of 200 mm/min±10% according to Japanese Industrial Standard JIS-K-7113 regarding testing of tensile properties of plastics.

2. The sealing member of claim 1, wherein the communicating hole or joint portion sealed by the sealing member comprises a stepped face of the recording/container unit.

3. An ink jet head comprising:

an ink container for holding ink;

an energy-generating element for generating energy for ejecting the ink held in the ink container;

an ink-ejecting portion corresponding to the energy-generating element; and a sealing member, having a film portion and a pressure-sensitive adhesive portion, for sealing the ink-ejecting portion of the ink jet head, said film portion having a thickness in a range of 30$\mu$ to 100$\mu$ and said adhesive portion having a dry thickness in a range of 30$\mu$ to 100$\mu$, said sealing member exhibiting a yield point at a load less than or equal to 9.81N/cm for a specimen 10 mm wide at a stress rate of 200 mm/min±10% according to Japanese Industrial Standard JIS-K-7113 regarding testing of tensile properties of plastics.

4. The ink jet head of claim 3 wherein said energy-generating element comprises an electrothermal transducer for generating thermal energy for ejecting the ink.

5. The ink jet head of claim 3, wherein the ink-ejecting portion sealed by the sealing member comprises a stepped structure.

6. A sealing member, comprising a film portion and an adhesive portion, for sealing with said adhesive portion a communicating hole or a joint portion between an interior and an exterior of a recording/container unit containing an ink, said film portion having a thickness in a range of 30$\mu$ to 100$\mu$ and said adhesive portion having a dry thickness in a range of 30$\mu$ to 100$\mu$, said adhesive portion being pressure-sensitive, and a folding load being exhibited less than or equal to 0.10 g/cm for a specimen 10 mm wide with a free length of 10 mm from an end of a specimen holder measured on a center of an electronic balance placed at a position 5 mm apart from the end of the specimen holder.

7. The sealing member of claim 6, wherein the film portion exhibits a yield point at a load less than or equal to 9.81N/cm for a specimen 10 mm wide at a stress rate of 200 mm/min±10% according to Japanese Industrial Standard JIS-K-7113 regarding testing of tensile properties of plastics.

8. An ink jet head comprising:

an ink container for holding ink;

an energy-generating element for generating energy for ejecting the ink held in the ink container;

an ink-ejecting portion corresponding to the energy-generating element; and a sealing member, having a film portion and a pressure-sensitive adhesive portion, for sealing the ink-ejecting portion, said film portion having a thickness in a range of 30$\mu$ to 100$\mu$ and said adhesive portion having a dry thickness in a range of 30$\mu$ to 100$\mu$, the sealing member exhibiting a folding load less than or equal to 0.10 g for a specimen 10 mm wide with a free length of 10 mm from the end of a specimen holder measured on the center of an electronic balance placed at a position 5 mm apart from the end of the specimen holder.

9. The ink jet head of claim 8, wherein said energy-generating element comprises an electrothermal transducer for generating thermal energy for ejecting the ink.

10. The ink jet head of claim 9, wherein the ink-ejecting portion comprises a stepped structure, and the folding load is less than or equal to 0.05 g/cm and greater than or equal to 0.01 g/cm.

11. A method for preventing leakage of ink from an ink-ejecting portion of an ink jet recording head, the method comprising the steps of:

providing a sealing member, having a film portion and a pressure-sensitive adhesive portion, for sealing the ink-ejecting portion of the ink jet head, providing said film portion with a thickness in a range of 30$\mu$ to 100$\mu$; and providing said adhesive portion with a dry thickness in a range of 30$\mu$ to 100$\mu$, said sealing member having a yield point property such that said sealing member exhibits a yield point at load less than or equal to 9.81N/cm for a specimen 10 mm wide at a stress rate of 200 mm/min±10% according to Japanese Industrial Standard JIS-k-7113 regarding testing of tensile properties of plastics; and pressing said sealing member onto said ink jet head, said sealing member being effective to prevent the ink leakage in accordance with the yield point property.

12. A method for preventing leakage of ink from an ink-ejecting portion of an ink jet recording head, the method comprising the steps of:

providing a sealing member, having a film portion and a pressure-sensitive adhesive portion, for sealing the ink-ejecting portion of the ink jet head, providing said film portion with a thickness in a range of 30$\mu$ to 100$\mu$; and providing said adhesive portion with a dry thickness in a range of 30$\mu$ to 100$\mu$, said sealing member having a folding property such that said sealing member exhibits a folding load less than or equal to 0.10 g/cm for a specimen of 10 mm wide with a free length of 10 mm from an end of a specimen holder measured on a center of an electronic balance placed at a position 5 mm apart from the end of the specimen holder; and pressing said sealing member onto said ink jet head, said sealing member being effective to prevent the ink leakage in accordance with the folding property.

* * * * *